US005520307A

United States Patent [19]

Miller et al.

[11] Patent Number: 5,520,307

[45] Date of Patent: May 28, 1996

[54] DISPENSING TOP FOR PILL CASE

[75] Inventors: Ronee Miller, P.O. Box 1353, New York, N.Y. 10021; Anna Freed, New York, N.Y.

[73] Assignee: Ronee Miller, New York, N.Y.

[21] Appl. No.: 81,678

[22] Filed: Jun. 23, 1993

[51] Int. Cl.[6] ..... G07F 11/54

[52] U.S. Cl. ..... 221/2; 221/8; 221/124; 221/130; 221/131; 221/152; 221/265; 221/277; 220/23.4; 220/253; 206/459.5; 206/534

[58] Field of Search ..... 221/2, 4, 5, 7, 221/8, 92, 123, 124, 130, 131, 132, 152, 154, 263, 264, 265, 277; 220/23.4, 253; 206/534, 459.5

[56] References Cited

U.S. PATENT DOCUMENTS

| | | | |
|---|---|---|---|
| 3,227,127 | 1/1966 | Gayle | 221/2 X |
| 4,372,445 | 2/1983 | Keffeler | 220/23.4 X |
| 4,460,106 | 7/1984 | Moulding, Jr. et al. | 221/4 X |
| 5,050,755 | 9/1991 | Strawder | 220/23.4 |
| 5,052,584 | 10/1991 | Dubach | 221/4 X |
| 5,239,491 | 8/1993 | Mucciacciaro | 221/2 X |

FOREIGN PATENT DOCUMENTS

| | | | |
|---|---|---|---|
| 2635507 | 2/1990 | France | 206/534 X |
| 3917052 | 12/1989 | Germany | 221/92 X |

OTHER PUBLICATIONS

Unconditional and Absolute Bill of Sale and Assignment by Anna Freed, Ronee Miller, and Paul D. Shirley, M.D., dated Aug. 1991.

*Primary Examiner*—Robert P. Olszewski
*Assistant Examiner*—Dean A. Reichard

[57] ABSTRACT

A medication dispenser cap and container comprises a base connected to the container and including a non-circular, for example polygonal, indication portion with multiple points or nodes. A cover which also has a non-circular shape is rotatably mounted to the base and moveable into aligned closed position with the base. The base includes multiple openings around its periphery and the cover includes one opening which can be aligned with one of the base openings to dispense medication, for example pills, from the container. The openings are aligned only when the cover is offset with respect to the base. This exposes parts of the base which may carry indicia that indicate when the dosage should be taken.

19 Claims, 6 Drawing Sheets

FIG. 2
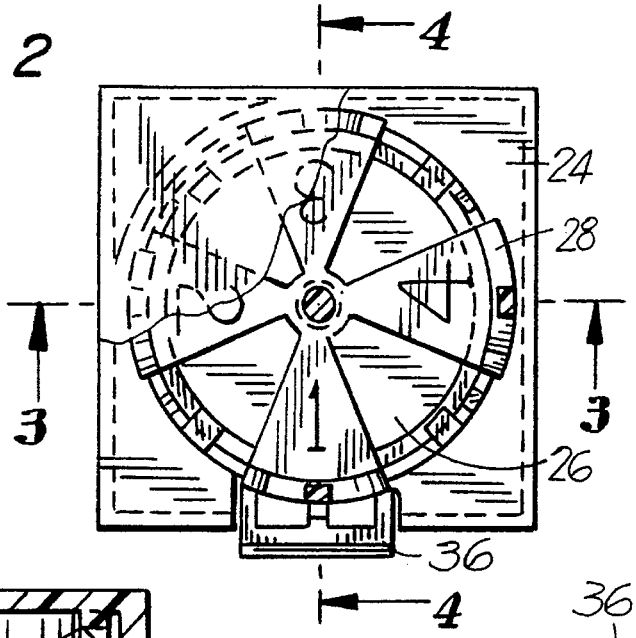
FIG. 3
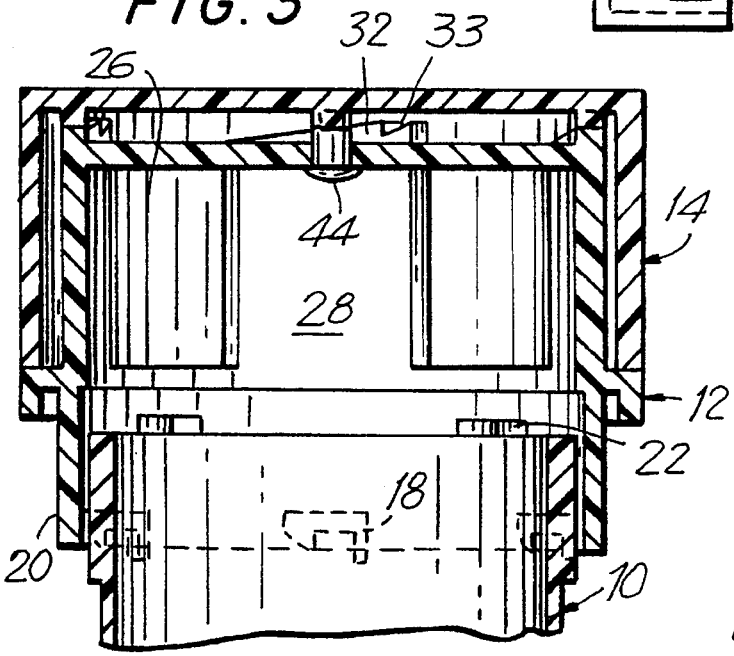
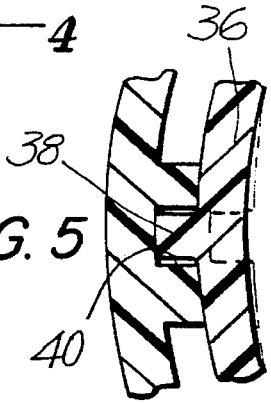
FIG. 5
FIG. 4
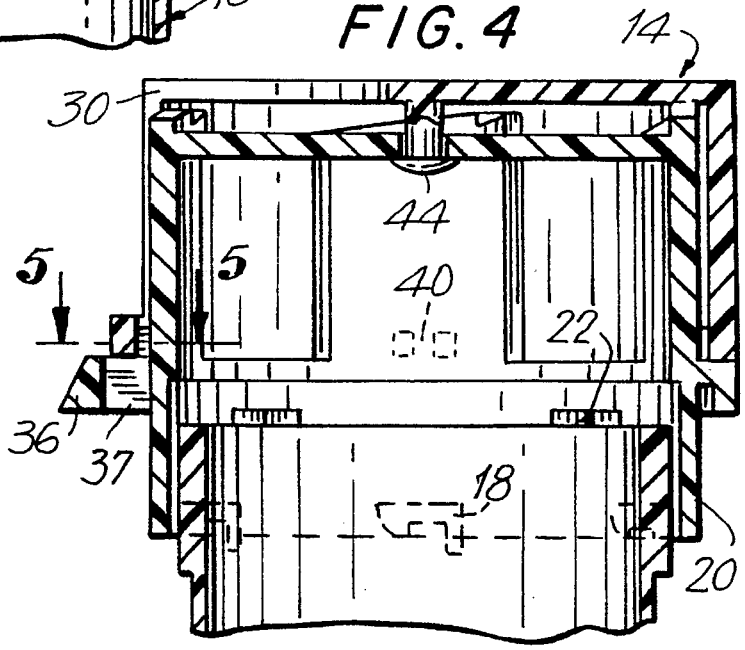
FIG. 6
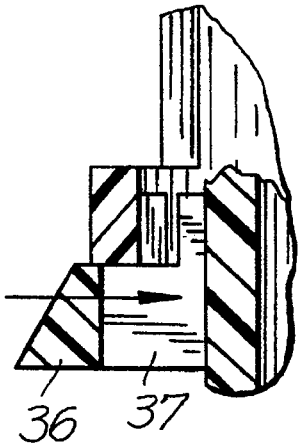

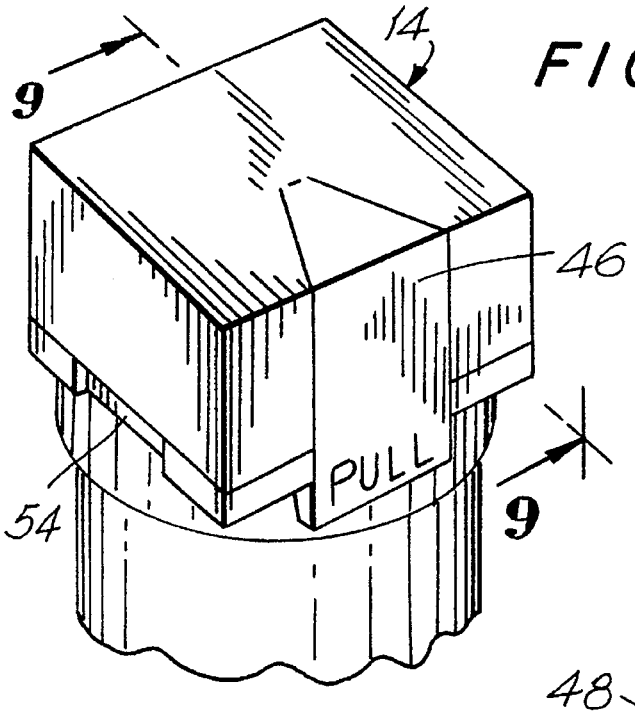
FIG. 8
FIG. 9
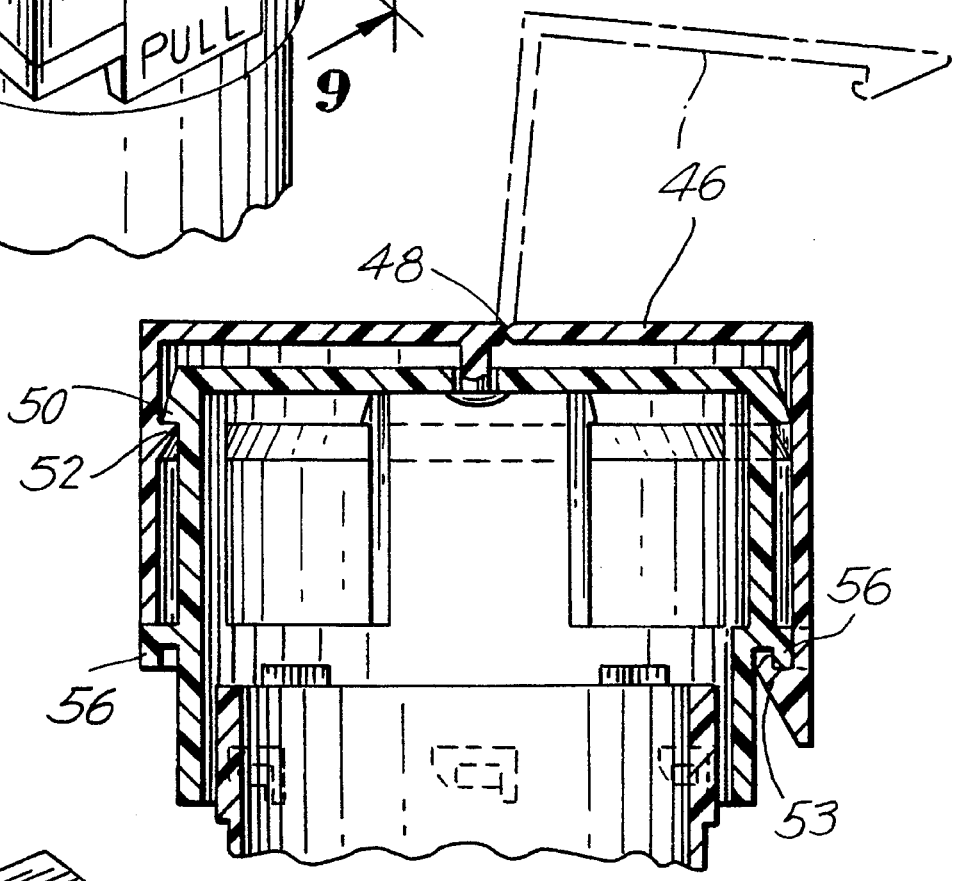
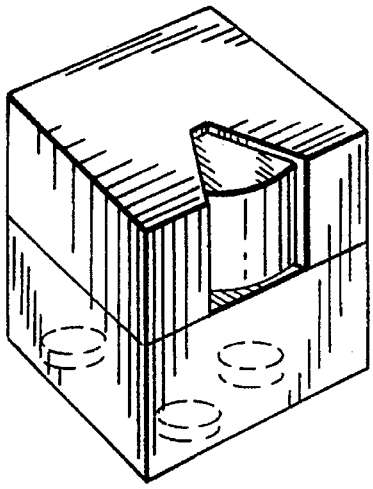
FIG. 10

FIG. 19
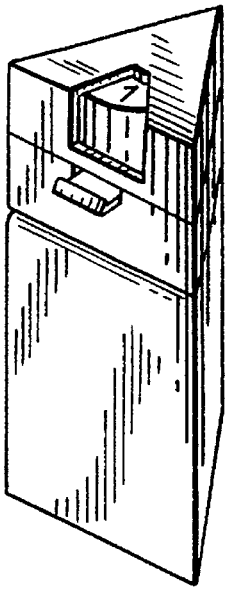
FIG. 20
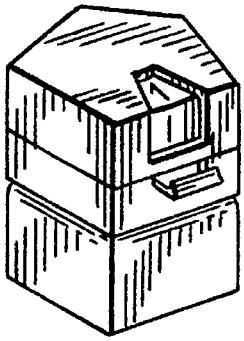
FIG. 21
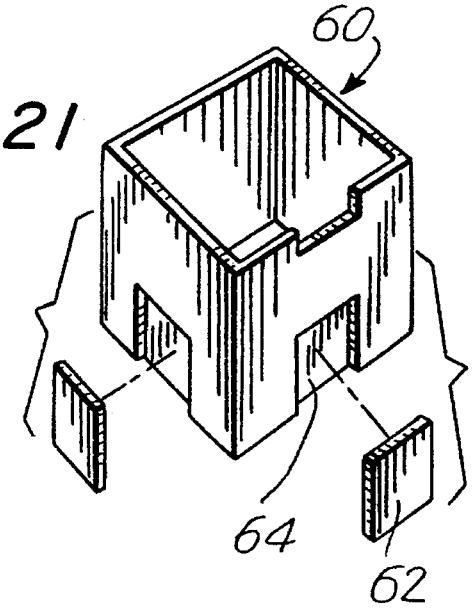
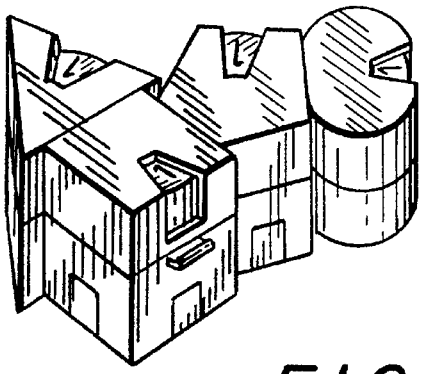
FIG. 22

DISPENSING TOP FOR PILL CASE

FIELD AND BACKGROUND OF THE INVENTION

The present invention relates in general to pill dispensers, and in particular to a new and useful top for a container of pills which, by its shape, clearly indicates the number of times per day the contained medication must be taken, and which further facilitates dispensing of the medication.

A wide variety of pill dispensers are known, including dispensers which provide the user with some indication on when a mediation, for example one or more pills, must be taken during the course of a day. U.S. Pat. No. 4,432,300 for example, discloses a dispenser with sequential dispensing and indicating cap. A cover portion of the cap has an aperture and is rotated to expose a marking, such as the word "MORN" indicating that the morning dosage must be taken. The cover can then be rotated further to expose an aperture through which a pill(s) for the morning dosage is dispensed. The cover and cap are cylindrical to match the cylindrical configuration of the pill container.

Multi-dose containers having safety lock features are also disclosed in U.S. Pat. Nos. 4,526,293 and 4,164,301.

A need remains for an improved cap for a pill case or container which provides dear visual and non-visual indications when a dosage must be taken, and which further facilitates dispensing of that dosage, particularly, but not limited to, by sight impaired individuals.

SUMMARY OF THE INVENTION

An object of the present invention is to provide a medication dispenser cap for a container comprising: a base adapted to be connected to the container and including a noncircular indicating portion having a plurality of nodes around its periphery for indicating the number of times a day medication is to be taken, the base including a plurality of closed portions that alternate with openings around the periphery of the base, each base opening being adjacent a node and each closed portion being between two adjacent nodes; and a cover mounted for rotation to the base for covering the base openings and closed portions, the cover having a plurality of nodes around its periphery which are of the same shape and equal in number to the nodes of the base. The cover has an opening between two adjacent nodes of the cover. The cover is rotatable into a plurality of closed positions with the nodes of the base and cover aligned and the cover opening aligned with one of the closed portions. The cover is further rotatable into a plurality of open positions with the nodes of the cover offset from the nodes of the base and the cover opening aligned with one of the base openings for dispensing a medication.

A further object of the present invention is to provide such a cap which has a plurality of nodes which form a square, other right polygon, ovals, star or other non-circular shape which, when the cover is rotated with respect to the base, exposes portions of the base.

Advantageously, indicia are provided on the exposed portions of the base when the cover is misaligned with the base, such as "morning", "afternoon" and the like. In this way, a dispensing opening is made in the container at the same time that indicia are displayed to the user for providing an unambiguous indication of which dosage is being taken. The configuration of the nodes acts as tactile indication as to the number of times the medication is taken each day. Equally, the alignment or misalignment of the nodes acts as a tactile indication that the cap is either in the closed or open position. A lock can be provided to positively hold the cover in each closed position. One way rotation means are also provided so that the cover can rotate only in one direction, to ensure the proper sequence of dosages, for example morning, afternoon, late afternoon, evening, etc.

A still further object of the invention is to provide a container for use with the cap and having magnetic attraction means so that multiple containers having different non-circular configurations can be held to each other. This is useful when several different medications must be taken at different times during the day. The shape of the chambers in such a situation would also act as an indication of which medication is in each chamber. Equally the caps may be color coded to indicate different medication.

A child-proof lid may also be provided on the cover opening for closing the cover opening despite its position on the base.

A still further object of the present invention is to provide a container for medications, in particular for pills, with a unique dispensing cap which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 2 is a top plan view thereof, with portions of the cover broken away to reveal underlying structures;

FIG. 3 is a slightly exposed sectional view taken along line 3—3 of FIG. 2;

FIG. 4 is a slightly exposed sectional view taken along line 4—4 of FIG. 2;

FIG. 5 is a fragmentary sectional view taken along line 5—5 of FIG. 4;

FIG. 6 is a fragmentary sectional view showing the lock structure for maintaining the correct closed position for the cover;

FIG. 8 is a perspective view of the second embodiment:,

FIG. 9 is a sectional view taken along line 9—9 of FIG. 8;

FIG. 10 is a perspective view of a further embodiment of the invention;

FIGS. 19–20 are perspective views of two of the additional embodiments;

FIG. 21 is a perspective view of a container constructed according to another feature of the invention; and FIG. 22 is a perspective view showing multiple containers according to the present invention, engaged with each other to form a cluster of containers.

DESCRIPTION OF THE PREFERRED EMBODIMENTS

Figure 1:
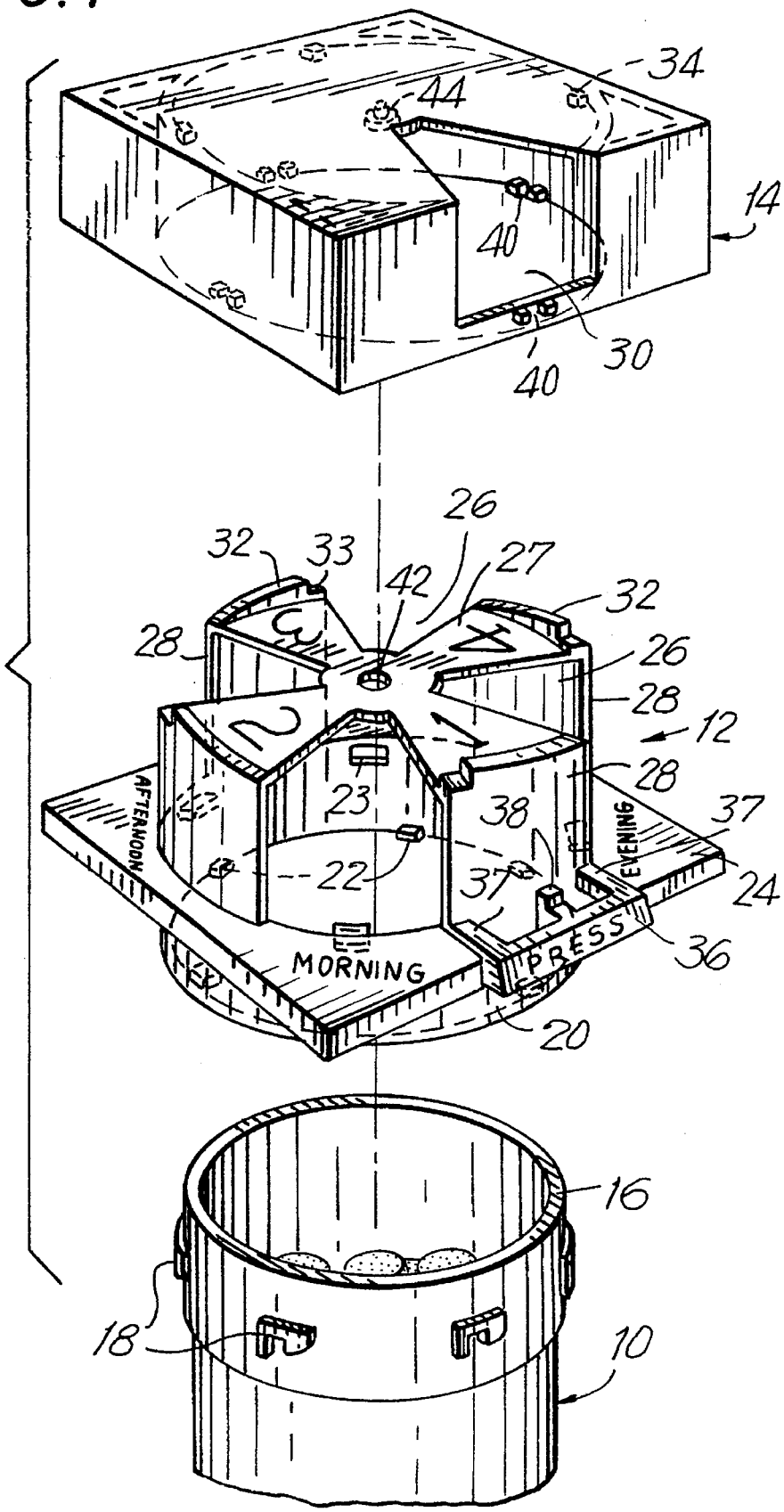
FIG. 1 is an exploded perspective view of a medication dispenser cap according to the present invention.

Referring to the drawings in particular, the invention embodied in FIGS. 1–6 comprises a medication dispenser cap for a medication container generally designated 10 which has an open neck 16 for receiving a supply of medication for example pills that must be taken more than once a day. Child-proof latches 18 of known design, are provided around the periphery of container neck 16 and are designed to mate with cams 22 on the inner surface of a cylindrical sleeve 20 which forms part of a base generally designated 12. Sleeve 20 of base 12 is moved downwardly onto neck 16 until flaps 23 which are slightly resilient, are pressed down against the upper periphery of the neck 16. At this point, base 12 is rotated to bring cams 22 into recesses in the latches 18.

A square flange 24 extends around and outwardly from sleeve 20. Flange 24 forms a non-circular indication portion for the base which has a plurality of nodes around the periphery of the base, which in this case form the four square corners of the square flange. The generic term nodes is used since it is intended to include not only polygonal shapes as the non-circular indication portion, but also rounded, oval or any other non-circular shape having discrete outwardly projecting portions, spaced around the periphery of the base.

A cover 14 which is also square in its outer plan view, is rotatably mounted to the base by engagement of a pivot pin 44 extending downwardly from the center of the cover, into a pivot hole 42 at the center of a covering cross shaped platform 27 over sleeve 20.

An upper end of the sleeve 20, above flange 24, forms a spoked platform 27, a plurality of alternating peripheral base opening 26 which alternate with peripheral closed portions 28 around the periphery of the base. Each of the openings 26 is adjacent one of the nodes or corners of the square flange 24 while each of the closed portions 28 is positioned between two adjacent nodes. For the square cap of the present invention, the closed portions 28 are positioned at each side of the square, between adjacent corners.

Figure 14:
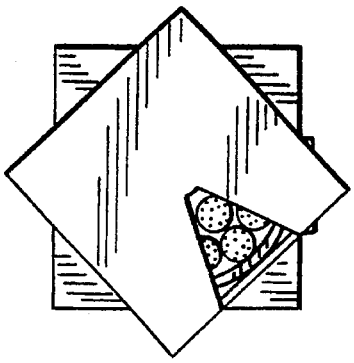
Figure 11:
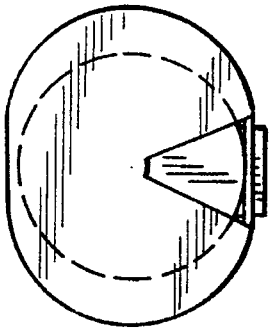
Figure 12:
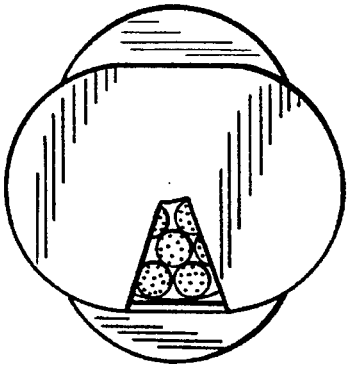

Cover 14 includes a single cover opening 30 which is also placed between adjacent nodes of the cover. Although the shape of opening 30 substantially matches the shape of the base openings 26, it is not essential that the two openings match but only that they can be brought into alignment when the cover 14 is rotated into a position on the base 12 where the nodes of the cover are offset from the nodes of the base. In this offset position which is best shown in FIG. 14, the cover opening is aligned with one of the base openings to allow pills to be dispensed from the container. This offset position also exposes a portion of the base on which information or indicia can be applied. This indicia is particularly useful if it indicates the time of day when the dosage must be taken.

With a square non-circular base and cover, four discrete time periods are possible. For the embodiment of FIG. 1, thus medication which must be taken four times a day can be filled into container 10. A morning dose is taken when the cover opening 30 is aligned with the opening 26 which is adjacent the comer or node labelled "MORNING" as shown in FIG. 1. In likewise fashion, subsequent nodes are labelled "AFTERNOON", "LATE AFTERNOON" (not shown) and "EVENING".

FIGS. 11–18 show other embodiments of the invention where non-circular base and cover combinations have two nodes (FIGS. 11, 12), three nodes (FIGS. 15, 16) and five nodes (FIGS. 17, 18) can be utilized for medication that must be taken two, three or five times a day. FIGS. 11, 13, 15 and 17 show the respective closed aligned positions while FIGS. 12, 14, 16 and 18 show respective offset and open positions.

Returning to FIGS. 1–6, additional mechanisms are provided in the cap to avoid errors or inadvertent movement of the cover.

Among these are one-way rotation means in the form of rack or ratchet segments 32 each having an inclined portion leading to a recess 33 defined on the upper edge of the cylindrical sleeve 20 in the cover portions 28. Racks and seats 32, 33 cooperation with pawls 34 extending downwardly from the interior of cover 14, to produce click stops at each of the four closed positions for the container, that is, when the cover opening 30 is aligned with one of the cover portions 28 and where all nodes of the cover 14 are aligned with all nodes of the base 12.

In this closed and aligned position, a slide or lock 36 which has branches 37 fixed to the sleeve 20 and, includes a stop post 38 which, in an unpressed condition, is seated in a stop recess 40 between two additional posts on the inner surface of cover 14, keeps the cover in its closed position. This anti-rotation means also prevents relative rotation between the cover and base.

To allow the cover to move, a cross member of slide 36, between branches 37, is pressed near the center. This bends the cross piece, moving stop post 38 inwardly and clear of the stop recess 40 (see the phantom line position in FIG. 5). In this pressed condition, cover 14 may be moved until its cover opening 30 aligns with the next base opening 26. Once the dosage is taken for the indicated time period, the cover is again rotated in the same direction (opposite rotational movement being impossible by rack and pawl 32, 34) until stop 38 clicks into the next stop recess 40. For this purpose, the top of stop 38 is bevelled so that it can slide under the stop post and engage into the recess 40. This engagement is illustrated in FIG. 5 while the direction of movement for the slide 36 is shown by the arrow in FIG. 6. It is noted that the posts that form stop recesses 40 are defined on the inner surface of a cylindrical sleeve inside cover 14. Base 12 and cover 14 can each be made of a single molded piece of plastic.

Figure 7:
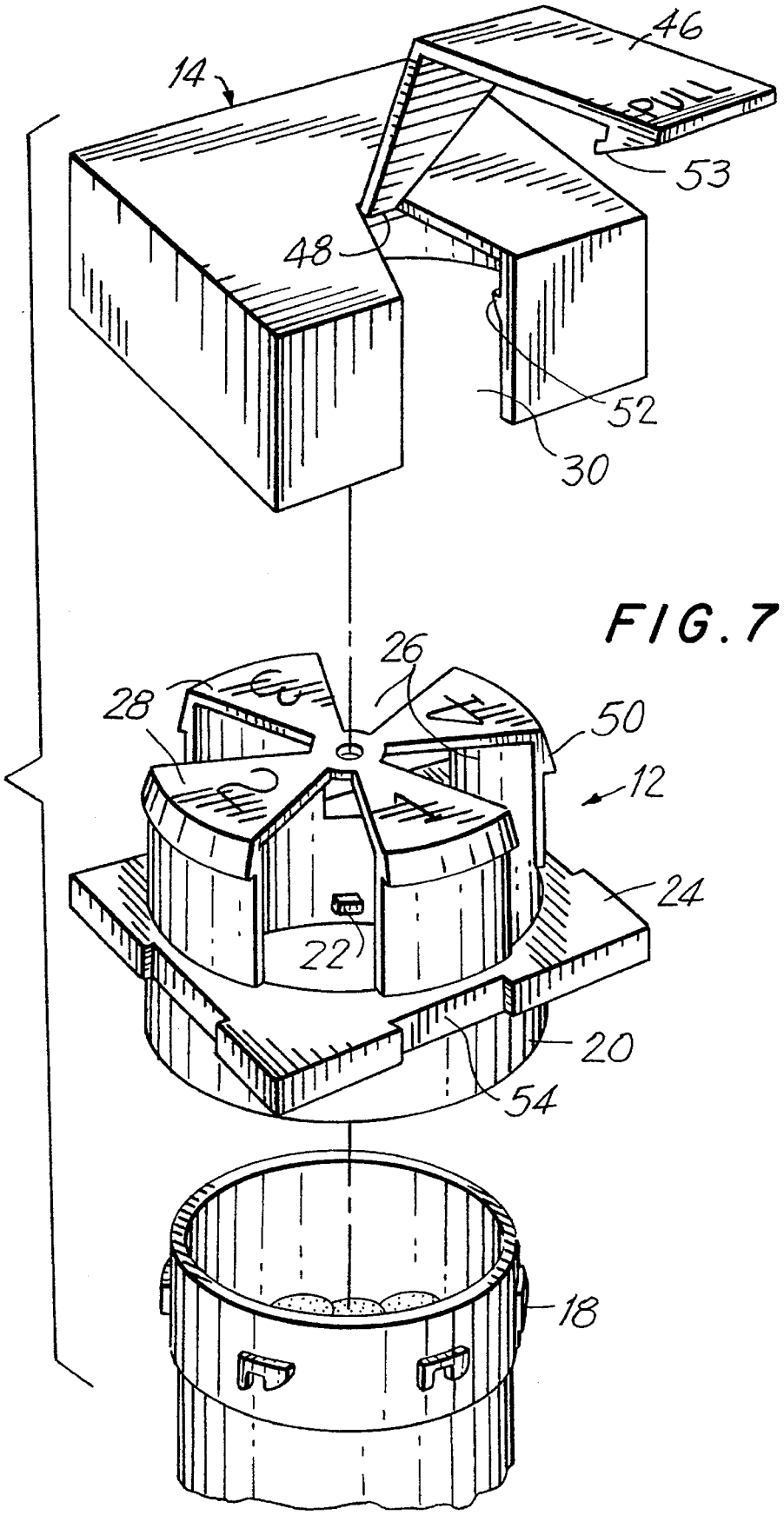
FIG. 7 is a view similar to FIG. 1 of a second embodiment of the invention.
Figure 17:
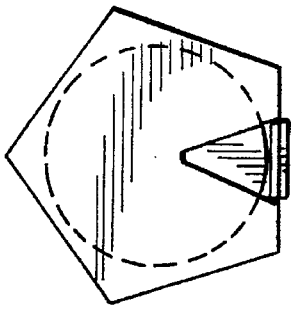
FIGS. 11–18 are top plan views of further embodiments of the invention shown in respective closed and open positions.
Figure 18:
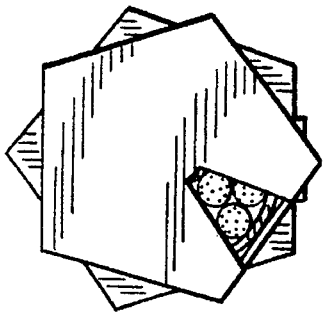
Figure 15:
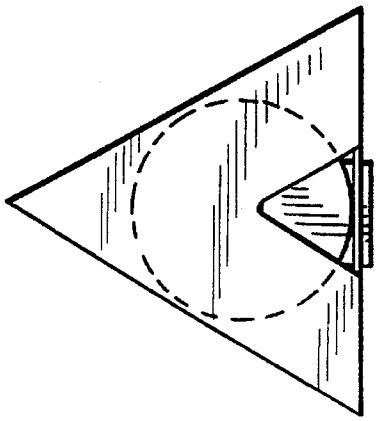
Figure 16:
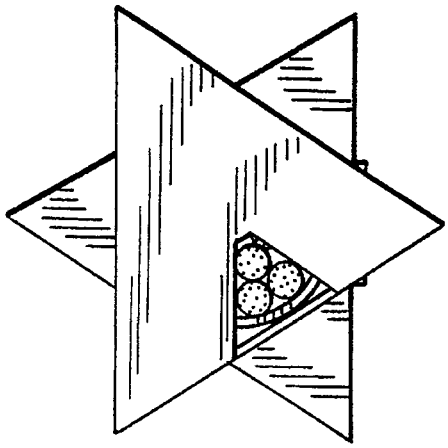
Figure 13:
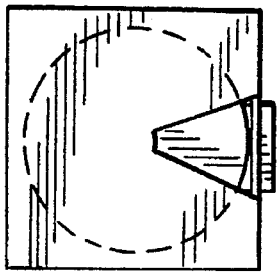

A second embodiment of the invention is shown in FIGS. 7–9. The same reference numerals are utilized in these and the remaining figures to designate the same or functionally similar parts. In the embodiment of FIG. 7 again a square cover 14 covers a base 12 having a square flange 24. Cover 14 is pivotally mounted to the base and includes a cover opening 30 which can be aligned with one of four base openings 26 each at a node of the base and alternating between cover portions 28 of the base. A lid 46 is mounted at a hinge 48 to the cover 14. Hinge 48 is simply a thin portion of the synthetic material making up the base and cap. The lid 46 acts to child proof the container. When not needed lid 46 can be removed by tipping it off at hinge 48.

Cover 14 is rotatably mounted to base 12 by engagement of overhanging steps 50 near the top of sleeve 20 and on each of the cover portions 28, with a step 52 mending inwardly around the circumference of a cylindrical sleeve within the square cover 14. This rotational engagement is best shown in FIG. 9.

To act as a lock and as anti-rotation means, flange 24 includes a lock recess 54 at each side thereof which receives a downwardly extending portion of lid 46 as best shown in FIG. 8. The downwardly extending portion of lid 46 includes a further step 53 which is engageable under a lip 56 extending downwardly from the flange at each side of the flange. Again, as shown in FIG. 9, engagement of step 53 over lip 56 locks the lid 46 in its closed position and, at the same time, acts as anti-rotation means to prevent inadvertent rotation of the lid. To dispense the next dosage of medication, the lower extension of lid 46 is pulled outwardly near the area marked "PULL" in FIG. 8, moving the lid into the position shown in FIG. 7 (and in FIG. 9 in phantom line). In this position, the cover 14 can be rotated to align the cover opening 30 with the next base opening 26. If desired, anti-rotation means can be provided in the form of biased teeth formed on the mating surfaces between stops 50 and 52 so that the cover can be rotated in only one direction.

FIG. 10 shows an embodiment of the invention where the container matches the non-circular shape of the cover.

FIGS. 19 and 20 are perspective views of the triangular and pentagonal versions of the invention each with a slide or lock for allowing rotation of the cover with respect to the base. FIG. 21 illustrates a square container 60 which can be used with an inventive dispensing cap. Magnets 62 are provided and fixed within recess 64 in each side of the container. In this way, multiple containers all outfitted with magnets can be held to each other by magnetic attraction as shown in FIG. 22. This produces an aesthetic cluster of containers which has a practical purpose in that multiple medications which must be taken different times during the day can be held together.

Returning to FIG. 1, another feature of the invention is the application of a number on each are of the spokes of the cover for the cylindrical base sleeve 20, indicating which dosage during the day has been taken. Numbers 1–4 are provided in the embodiment of FIGS. 1 and 4, while 2, 3 or 5 sequential numerals can be provided on the double, triple and five dose version of the invention. In the duster of FIG. 22, confusion can be avoided in that the dosage number which must next be taken, is clearly visible.

While the specific embodiments of the invention have been shown and described in detail to illustrate the application of the principles of the invention, it will be understood that the invention may be embodied otherwise without departing from such principles.

What is claimed is:

1. A medication dispenser cap for a container comprising:

a base adapted to be connected to the container and including a non-circular indicating portion having a plurality of nodes around its periphery for indicating a plurality of dosages, the base including a plurality of closed portions that alternate with base openings around the periphery of the base, each base opening being adjacent a node and each closed portion being between two adjacent nodes; and a cover mounted for rotation to the base for covering the base openings and closed portions, the cover having a plurality of nodes around its periphery which are equal in number to the nodes of the base, the cover having a cover opening therein, between two adjacent nodes of the cover so that the cover is rotatable into a plurality of closed positions with the nodes of the base and cover aligned and the cover opening aligned with one of the closed portions, and into a plurality of open positions with the nodes of the cover offset from the nodes of the base and the cover opening aligned with one of the base openings for dispensing a medication.

2. A cap according to claim 1, including anti-rotation means engaged between the base and the cover when the cover is in one of the closed positions, for preventing inadvertent rotation of the cover on the base.

3. A cap according to claim 2, wherein the anti-rotation means comprises a stop mounted to one of the base and cover, and a stop recess in the other of the base and cover for receiving the stop, the stop being removable out of the stop recess for permitting rotation of the cover on the base.

4. A cap according to claim 2, wherein said anti-rotation means comprises a lid movably mounted to the cover for closing the cover opening, the base including a stop recess for receiving a portion of the lid when the cover and base are in one of the closed positions, for precluding rotation of the cover on the base, the lid being moveable to a position exposing the cover opening and away from the stop recess to permit rotation of the cover on the base.

5. A cap according to claim 2, including one-way rotation means engaged between the base and cover for allowing rotation of the cover in only one direction on the base.

6. A cap according to claim 5, wherein said one-way rotation means comprises a rack formed on the base and a pawl formed on the cover engageable in the rack.

7. A cap according to claim 1, including one-way rotation means engaged between the base and cover for allowing rotation of the cover in only one direction on the base.

8. A cap according to claim 1, wherein portions of the base are exposed near each node of the base when the cover is in each open position, the base including indicia on each exposed portion indicating the time for a dosage from an open base opening.

9. A cap according to claim 1, wherein the base comprises a sleeve for engagement to a the container, said non-circular indicating portion comprises a flange mending outwardly from the sleeve.

10. A cap according to claim 9, wherein the flange is polygonal.

11. A cap according to claim 9, wherein the flange is non-circular.

12. A cap according to claim 5, wherein the base comprises a sleeve for engagement to a the container, said non-circular indicating portion comprises a flange extending outwardly from the sleeve.

13. A cap according to claim 1, wherein the non-circular indication portion is polygonal, each node of the base comprising a corner of the polygonal shape, the cover being a polygonal solid with each corner of the polygonal solid forming a node of the cover, the cap including one-way rotation means engaged between the base and cover for allowing rotation of the cover in only one direction on the base, and anti-rotation means for locking the cover in one of the closed positions to the base, at least a portion of the anti-rotation means being movable for allowing rotation of the cover on the base into one of the open positions.

14. A dispenser cap and container combination for medication comprising:

a container body with a neck having an opening for receiving medication;

a base connected to the container neck and including a non-circular indicating portion having a plurality of nodes around its periphery for indicating a plurality of dosages, the base including a plurality of closed portions that alternate with base openings around the periphery of the base, each base opening being adjacent a node and each cover portion being between two adjacent nodes; and a cover mounted for rotation to the base for covering the base openings and closed portions, the cover having a plurality of nodes around its periphery which are equal in number to the nodes of the base, the cover having a cover opening therein, between two adjacent nodes of the cover so that the cover is rotatable into a plurality of closed positions with the nodes of the base and cover aligned and the cover opening aligned with one of the closed portions, and into a plurality of open positions with the nodes of the cover offset from the nodes of the base and the cover opening aligned with one of the base openings for dispensing a medication.

15. A combination according to claim 14, including anti-rotation means engaged between the base and the cover when the cover is in one of the closed positions, for preventing inadvertent rotation of the cover on the base.

16. A combination according to claim 15, including one-way rotation means engaged between the base and cover for allowing rotation of the cover in only one direction on the base.

17. A combination according to claim 16, wherein the base comprises a sleeve for engagement to the neck of the container, the non-circular indicating portion comprising a flange extending outwardly from the sleeve.

18. A combination according to claim 14, wherein the container body includes a plurality of sides which are each at least partly flat, each flat side including engagement means for engaging the flat side of another container to form a cluster of containers.

19. A combination according to claim 18, wherein said engagement means comprises a magnet in each side of the container body.

* * * * *